US005617095A

United States Patent [19]

Kim et al.

[11] Patent Number: 5,617,095

[45] Date of Patent: Apr. 1, 1997

[54] HYBRID TYPE WIDE BAND ELECTROMAGNETIC WAVE ABSORBER

[75] Inventors: Dong-Young Kim; Yeon-Choon Chung, both of Daejeon-Si, Rep. of Korea

[73] Assignee: Korea Research Institute of Standards & Science, Rep. of Korea

[21] Appl. No.: 543,260

[22] Filed: Oct. 18, 1995

[30] Foreign Application Priority Data

Jul. 14, 1995 [KR] Rep. of Korea ..... 95-20682

[51] Int. Cl.[6] ..... H01Q 17/00

[52] U.S. Cl. ..... 342/1; 342/4

[58] Field of Search ..... 342/1, 2, 3, 4

[56] References Cited

U.S. PATENT DOCUMENTS 3,754,255 8/1973 Suetake et al. ..... 342/4

4,023,174 5/1977 Wright ..... 342/4

5,453,745 9/1995 Kudo et al. ..... 342/1

*Primary Examiner*—John B. Sotomayor

*Attorney, Agent, or Firm*—Adams & Wilks

[57] ABSTRACT

A hybrid-type wide band electromagnetic wave absorber having cone-shaped projections of a reduced may be produced by matching the impedance of the cone-shaped absorber members and the underlying plate type absorber. Such a hybrid-type wide band electromagnetic wave absorber is formed by arranging tapered cone-shaped members in a regular pattern on a sintered ferrite plate, which is disposed on a metal plate. The cone-shaped members are formed of a material selected from a ferrite and a ferrite composite and each have a normalized cross-sectional area at the base of $0<S_0<1$ and an exponent of cone shape of $0<n<10$. Such a hybrid type electromagnetic wave absorber may be used, for example, for performing EMI/EMS testing in an anechoic chamber in the frequency range of 30 MHz to 1 GHz. In the case of applications such as antenna testing in the frequency range of 30 MHz to 30 GHz, the height of the cone-shaped members must be appropriately increased.

11 Claims, 2 Drawing Sheets

HYBRID TYPE WIDE BAND ELECTROMAGNETIC WAVE ABSORBER

FIELD OF THE INVENTION

The present invention relates to a hybrid type wide band electromagnetic wave absorber.

DESCRIPTION OF THE PRIOR ART

A hybrid electromagnetic wave absorber, which is a composite structure, comprises a wedge or pyramid shaped absorber made of a radar absorbing material(RAM) mounted upon a ferrite plate. The hybrid absorber is intended to absorb electromagnetic waves with greater than −20 dB reflection loss in the frequency range of 30 MHz–30 GHz. The hybrid absorber is conventionally used in an anechoic chamber for antenna performance test and in electromagnetic wave interference (EMI) and/or electromagnetic wave susceptibility (EMS) testing of electronic apparatuses.

In the prior art the ferrite plate or ferrite grid type absorber has been used in an anechoic chamber for performing EMI/EMS testing. However, these absorbers cannot satisfy the reflection loss of greater than −20 dB in the frequency range of 30 MHz–1 GHz. Recently, the 3-layered absorber, which comprises a ferrite and ferrite composite membrane together with an air layer of 3–5 cm thickness inserted them, was developed, and it has superior wide band electromagnetic wave absorbing characteristics. When the 3-layered absorber is used in the anechoic chamber, however, the air layer is replaced with a wood or a low dielectric material. Consequently, the absorbing characteristics can be aggravated, and the structure is wider than the single layered ferrite absorbers.

While the hybrid absorber has been used in an anechoic chamber for the antenna performance test in the frequency range of 30 MHz–30 GHz, the wedge or pyramid absorber is made of a lossy dielectric material formed by impregnating carbon into polyuretane or polystyrene, and about 100 cm height is needed. However, it is still too high. Much effort has been devoted to reducing the height of absorber while still maintaining the absorbing characteristics.

Optimizing the impedance matching condition between the ferrite plate and wedge or pyramid absorber in the hybrid absorber is most important to improve the absorbing characteristics. The ferrite introduces both the electric and magnetic material properties, while the dielectric lossy material has only electric properties. The proper impedance matching condition between the two materials is very difficult to obtain, thus, it requires the wedge or pyramid absorber having the height of about 100 cm. Consequently, the ferrite or ferrite composite material, which have both the electric and magnetic material properties, are the best candidates for the wedge or pyramid absorber.

SUMMARY OF THE INVENTION

The hybrid type wide band electromagnetic wave absorber according to the present invention comprises a plurality of square arrays of tapered cone ferrite or ferrite composite material upon the sintered ferrite plate.

For the plate on which the tapered cone ferrite or ferrite composite material is arranged in a regular square form, a cross section per unit area at the bottom of cone, $S_0$, and an exponent of cone shape, n, can be changed to adjust the effective electric and magnetic material properties. As the matching condition is optimized, the absorbing frequency band for reflection loss ≦−20 dB can be maximized and the height of absorber can be also reduced to minimum level.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
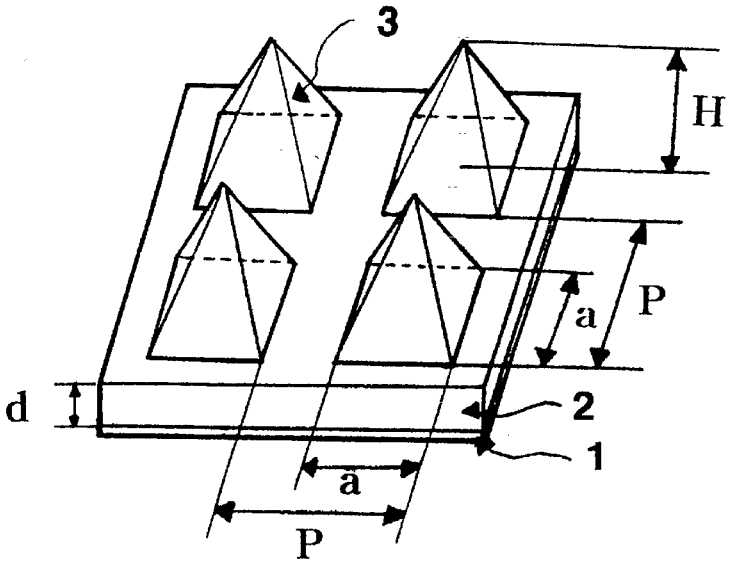
FIG. 1 illustrates the structure of the hybrid type wide band electromagnetic wave absorber according to the present invention.

FIG. 1 illustrates the structure of the hybrid type wide band electromagnetic wave absorber according to the present invention.

A sintered ferrite plate 2 is disposed upon a metal plate 1, and a tapered cone of ferrite or ferrite composite material 3 is arranged thereupon in a regular form. In FIG. 1, H indicates the height of the cone, d indicates the thickness of the sintered ferrite plate, P indicates the period of the regularly arranged tapered cone ferrites or the ferrite composite materials, and "a" indicates the length of the edge at the bottom of the cone.

The normalized cross section S of the tapered cone ferrite or ferrite composite material is expressed by the following relationship.

$$S=S_0z^n \tag{1}$$

where $S_0=a^2/P^2$ indicates the cross section per unit area at the bottom of tapered cone3, n represents an exponent of cone shape, and z is the normalized distance from bottom to top of the tapered cone raging of 0 to 1.

Figure 2:
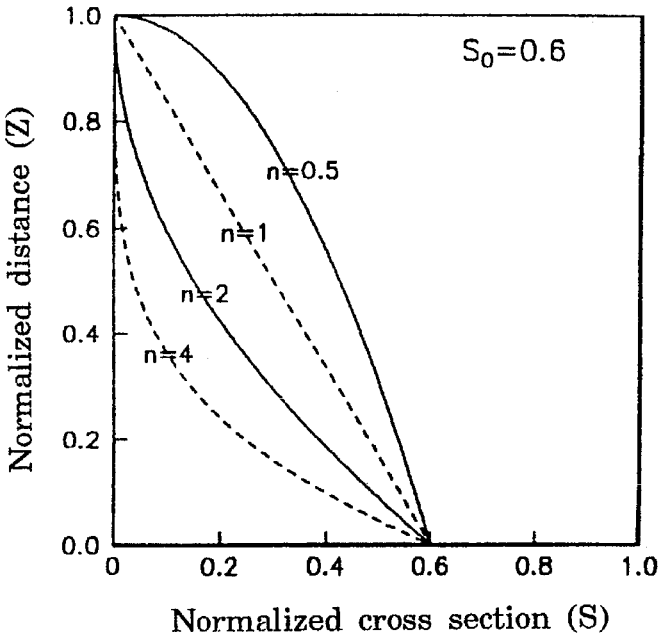
FIG. 2 are curves showing the variations of the normalized cross section with the normalized height of FIG. 1 for several exponent of cone shape, n.

FIG. 2 illustrates examples of the variations of the normalized cross section S with normalized distance Z for n=0.5, 1, 2 and 4 at $S_0$=0.6. The S curves of n=1 and n=2 indicate the wedge and pyramid shape, respectively.

In the hybrid type wide band electromagnetic wave absorber according to the present invention, the tapered cones are made of a ferrite or a ferrite composite material. The normalized cross section at the bottom of tapered cone is $0 \leqq S_0 \leqq 1$, and the exponent of cone shape is $0 \leqq n \leqq 10$.

In the case of designing the radio wave absorber for EMI/EMS test in the frequency range of 30 MHz–1 GHz, the height of the tapered cone may be low.

Figure 3:
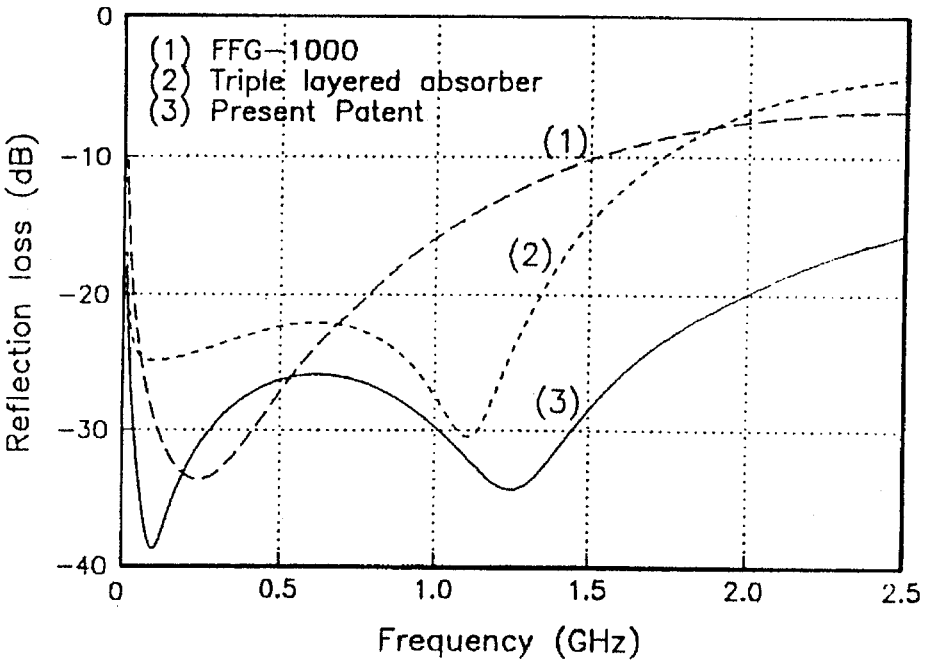
FIGS. 3 and 4 graphically illustrate the absorbing characteristics of the hybrid type wide band electromagnetic wave absorber according to the present invention.

Referring to FIG. 3, the dotted lines (1) and (2) indicate the absorbing characteristics of FFG-1000 which is a commercial ferrite grid absorber and of a 3-layered absorber, respectively. The solid line (3) indicates an example of the absorbing characteristics of the radio wave absorber of the present invention for the EMI/EMS test. In the solid line (3), the sintered ferrite plate is MnZn ferrite having high permeability, the tapered cone is NiZn ferrite, H=2.0 cm, $S_0$=0.48 and n=0.1.

As shown in FIG. 3, the hybrid type wide band electromagnetic wave absorber according to the present invention shows superior absorbing characteristics over a wider frequency band than that of conventional ferrite grid or 3-layered absorbers.

In the case of designing the wide band electromagnetic wave absorber for antenna performance test in the frequency range of 30 MHz–30 GHz, the height of the tapered cone has to be much higher.

Figure 4:
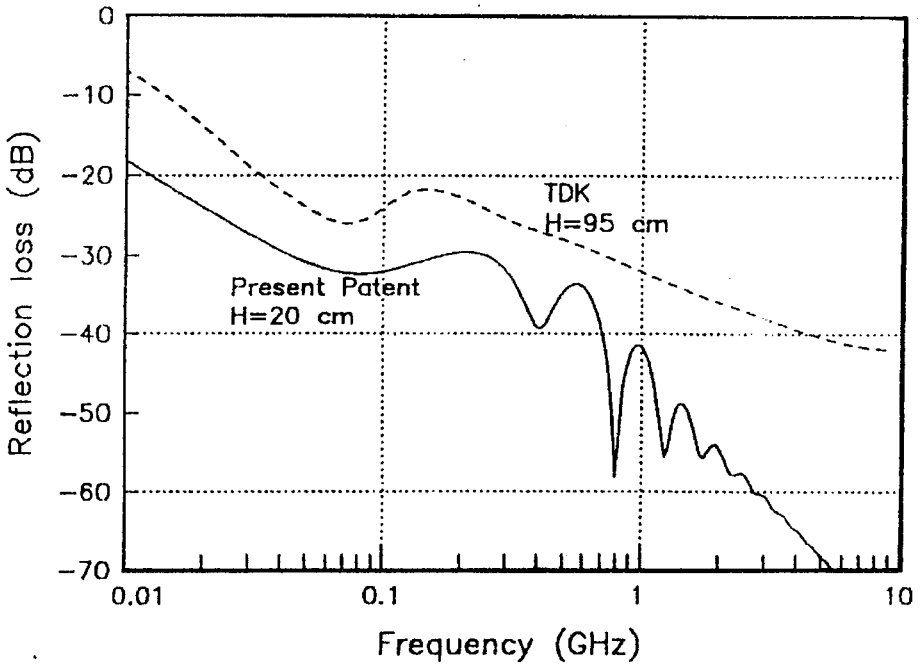

Referring to FIG. 4, the dotted line is the absorbing characteristics of the hybrid absorber reported by the TDK corporation, where the wedge absorber (n=1) made of dielectric lossy material is used and the height is 95 cm. While the solid line shows an example of the absorbing characteristics of the hybrid type electromagnetic wave absorber, where pyramid absorber (n=2) made of NiZn ferrite is used, the height is 20 cm and $S_0$=0.8.

As shown in FIG. 4, the hybrid type wide band electromagnetic wave absorber according to the present invention shows superior absorbing characteristics than than that of the conventional hybrid absorber. Further, the absorber according to the present invention has an advantage such that the height of the tapered cone can be reduced to the minimum level.

What is claimed is:

1. A hybrid type wide band electromagnetic wave absorber comprising: a metal plate; a sintered ferrite plate disposed on the metal plate; and a plurality of spaced apart tapered cone members formed of a ferrite or ferrite composite material arranged in a regular square form on the sintered ferrite plate.

2. A hybrid type wide band electromagnetic wave absorber according to claim 1; wherein the tapered cone members each have a normalized cross section at a bottom thereof within the range of $0<S_0<1$, wherein $S_0=a^2/P^2$, "a" denotes the length of an edge at the bottom of a respective member and "P" denotes a pitch between adjacent members.

3. A hybrid type wide band electromagnetic wave absorber according to claim 1; wherein the tapered cone members each have an exponent of cone shape within the range of $0 \leqq n \leqq 10$.

4. An electromagnetic wave absorber comprising: a metal plate; a ferrite-containing planar member disposed on the metal plate; and at least one ferrite-containing tapered member disposed on the ferrite-containing planar member; wherein the impedance of the ferrite-containing tapered member is matched to the impedance of the ferrite-containing planar member to permit a reduction in height of the tapered member over an expanded bandwidth.

5. An electromagnetic wave absorber according to claim 4; wherein the ferrite-containing planar member comprises a sintered ferrite plate.

6. An electromagnetic wave absorber according to claim 4; wherein the ferrite-containing tapered member comprises a pyramid-shaped absorber formed of a ferrite or a ferrite composite material.

7. An electromagnetic wave absorber according to claim 4; wherein the at least one ferrite-containing tapered member comprises a plurality of members each spaced apart from each other.

8. An electromagnetic wave absorber according to claim 7; wherein the respective tapered members each have a normalized cross-sectional area at an interface between the planar member and the respective tapered member within the range of zero to one.

9. An electromagnetic wave absorber according to claim 7; wherein the respective tapered members each have an exponent of cone shape between zero and ten.

10. An electromagnetic wave absorber according to claim 4; wherein the at least one tapered member has a normalized cross-sectional area at an interface between the planar member and the at least one tapered member within the range of zero to one.

11. An electromagnetic wave absorber comprising: a metal plate; a sintered ferrite plate disposed on the metal plate; and a plurality of pyramid-shaped members disposed in a predetermined pattern on the sintered ferrite plate, each pyramid-shaped member being formed of a material selected from a ferrite or a ferrite composite and having a normalized cross-sectional area at a base thereof within the range of zero and 1, such that the impedance of the sintered ferrite plate may be matched to the impedance of the pyramid-shaped members and the height of the respective pyramid-shaped members may be reduced below 100 cm in the frequency range of 30 MHz to 1 GHz.

* * * * *